US006193200B1

(12) United States Patent
Kao

(10) Patent No.: US 6,193,200 B1
(45) **Date of Patent: *Feb. 27, 2001**

(54) TOOL SUSPENSION RACK

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/183,898

(22) Filed: Oct. 30, 1998

(51) Int. Cl.[7] ..... A47F 7/00

(52) U.S. Cl. ..... 248/309.1; 248/688; 211/70.6; 206/349

(58) Field of Search ..... 248/309.1, 688, 248/110, 111, 225.21, 221.11, 222.14, 222.13; 206/349, 377, 481, 806; 211/70.6

(56) References Cited

U.S. PATENT DOCUMENTS

| | | | | |
|---|---|---|---|---|
| 2,172,687 | * | 9/1939 | Anderson et al. | 248/688 |
| 3,275,274 | | 9/1966 | Hutcheon | 248/309.1 |
| 3,927,765 | * | 12/1975 | Beal | 206/481 |
| 4,062,512 | * | 12/1977 | Arnold | 248/309.1 |
| 4,450,961 | | 5/1984 | Bies et al. | 206/349 |
| 4,634,005 | | 1/1987 | Kulzer et al. | 206/477 |
| 4,684,094 | * | 8/1987 | Everett | 248/245 |
| 4,729,473 | | 3/1988 | Kulzer et al. | 206/477 |
| 4,813,642 | * | 3/1989 | Matsui | 248/221.3 |
| 5,044,591 | | 9/1991 | Huang | 248/317 |
| 5,439,120 | * | 8/1995 | Brozak | 206/806 |
| 5,484,056 | | 1/1996 | Wood | 206/349 |
| 5,501,330 | | 3/1996 | Betts | 206/349 |
| 5,713,467 | * | 2/1998 | Kao | 206/349 |
| 5,906,350 | * | 5/1999 | Kao | 248/688 |
| 5,996,817 | * | 12/1999 | Kao | 248/221.11 |
| 6,076,669 | * | 6/2000 | Ling | 206/349 |

* cited by examiner

*Primary Examiner*—Ramon O. Ramirez
*Assistant Examiner*—Jon Szumny

(57) ABSTRACT

A tool suspension rack includes a suspension plate having a first end portion and a second end portion containing two spaced elongate slide slots extending therethrough, each of the two slide slots having a first end portion and a second end portion formed with a locking sheet, a substantially U-shaped supporting bracket including two end portions each formed with an ear extending laterally and abutting the second end portion of the suspension plate, and two snapping members each mounted on each of the two ears of the supporting bracket, wherein each of the two snapping members is slidable in one of the two corresponding slide slots and is releasably locked by the locking sheet.

6 Claims, 7 Drawing Sheets

TOOL SUSPENSION RACK

CROSS-REFERENCES TO RELATED APPLICATIONS

Not Applicable.

BACKGROUND OF THE INVENTION

1. Field of the Invention

The present invention relates to a suspension rack, and more particularly to a tool suspension rack.

2. Description of the Related Art

The closest prior art of which the applicant is aware is disclosed in his U.S. patent application Ser. No. 08/918,995, entitled by "WRENCH SUSPENSION RACK".

BRIEF SUMMARY OF THE INVENTION

In accordance with one aspect of the present invention, there is provided a tool suspension rack comprising a suspension plate including a first end portion and a second end portion containing two spaced elongate slide slots extending therethrough, each of the two slide slots having a first end portion and a second end portion formed with a locking sheet, a substantially U-shaped supporting bracket including two end portions each formed with an ear extending laterally and abutting the second end portion of the suspension plate, and two snapping members each mounted on each of the two ears of the supporting bracket, wherein each of the two snapping members is slidable in one of the two corresponding slide slots and is releasably locked by the locking sheet.

In accordance with another aspect of the present invention, there is provided a tool suspension rack comprising a suspension plate including a first end portion and a second end portion, a substantially U-shaped supporting bracket including two end portions each formed with an ear extending laterally and abutting the second end portion of the suspension plate, the ear containing an elongate slide slot extending therethrough and having a first end portion and a second end portion formed with a locking sheet, and two spaced snapping members each mounted on the second end portion of the suspension plate, wherein each of the two snapping members is slidable in the respective slide slots and is releasably locked by the locking sheet.

Further benefits and advantages of the present invention will become apparent after a careful reading of the detailed description with appropriate reference to the accompanying drawings.

DETAILED DESCRIPTION OF THE INVENTION

Figure 1:
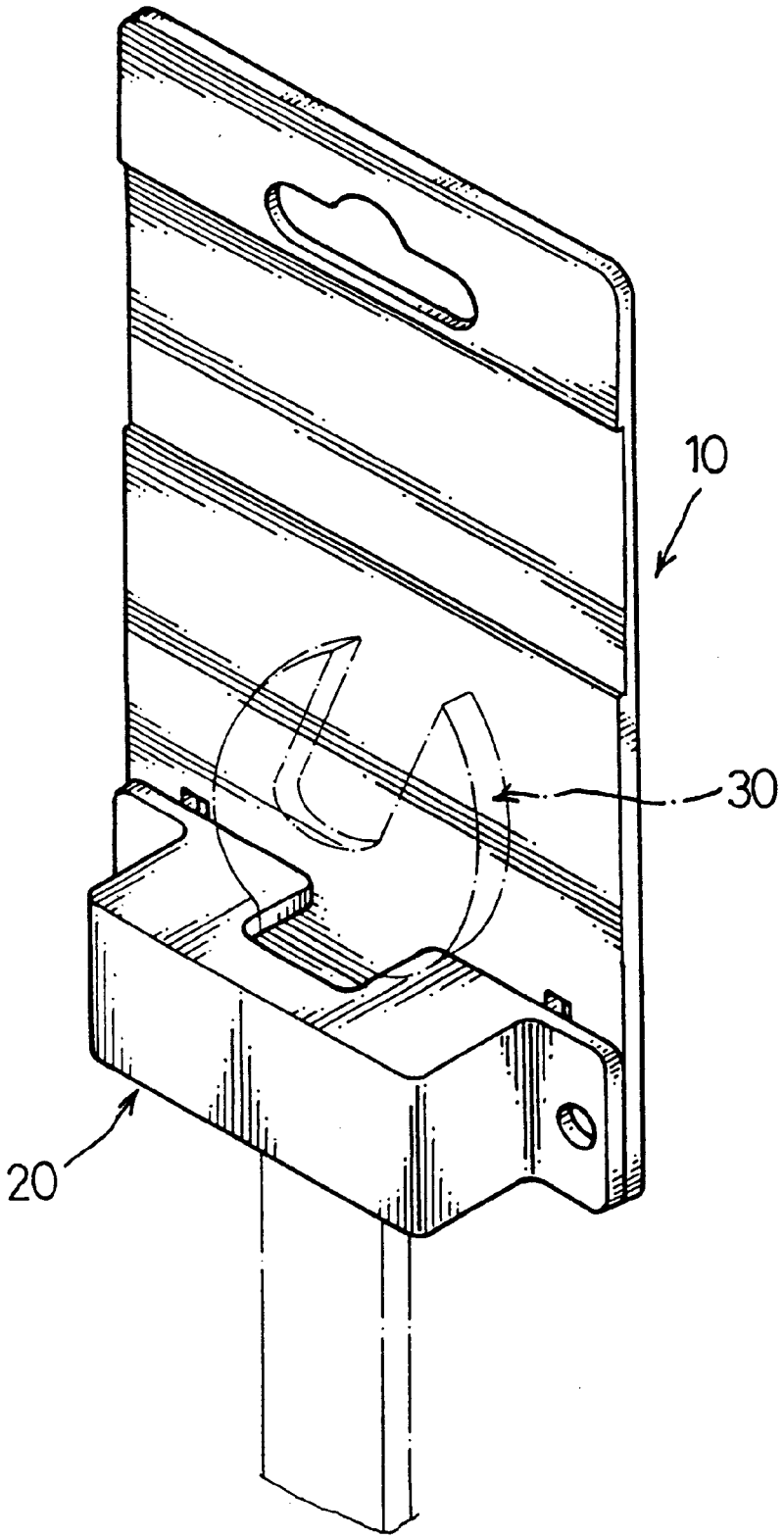
FIG. 1 is a perspective view of a tool suspension rack in accordance with a first embodiment of the present invention.
Figure 2:
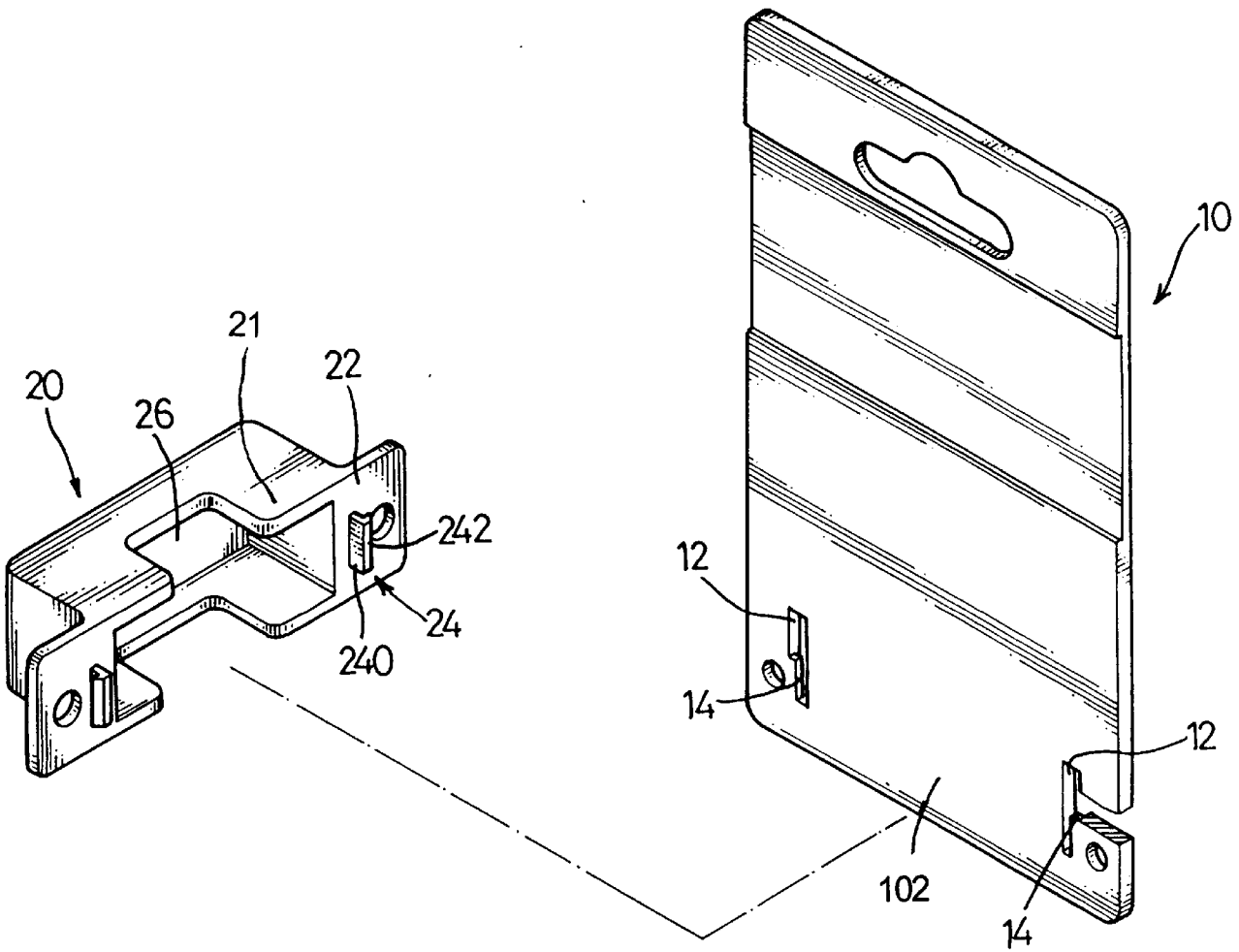
FIG. 2 is an exploded perspective view of the tool suspension rack as shown in FIG. 1.
Figure 3:
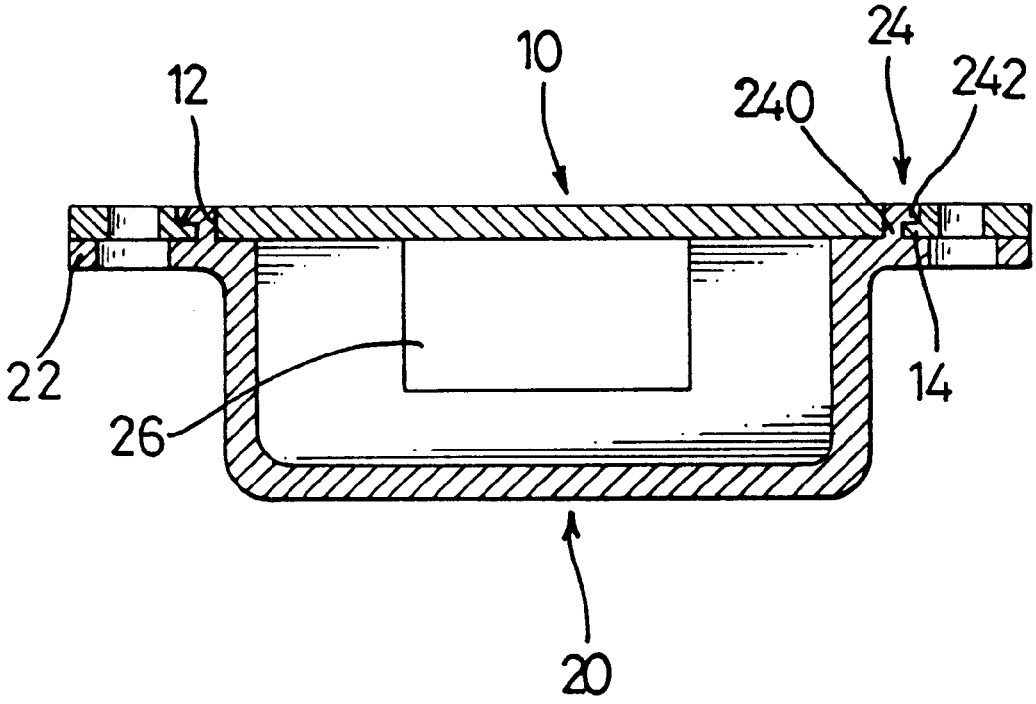
FIG. 3 is a top plan cross-sectional view of the tool suspension rack as shown in FIG. 1.

Referring now to FIGS. 1–3, a tool suspension rack in accordance with a first embodiment of the present invention comprises a suspension plate (10) including a first end portion and a second end portion (102) containing two spaced elongate slide slots (12) extending therethrough, each of the two slide slots (12) having a first end portion and a second end portion formed with a locking sheet (14), a substantially U-shaped supporting bracket (20) including two end portions (21) each formed with an ear (22) extending laterally and abutting the second end portion (102) of the suspension plate (10), and two snapping members (24) each mounted on each of the two ears (22) of the supporting bracket (20), wherein each of the two snapping members (24) is slidable in one of the two corresponding slide slots (12) and is releasably locked by the locking sheet (14). The U-shaped supporting bracket (20) contains a receiving space (26) for receiving therein a tool such as an open spanner (30).

Each of the two snapping members (24) includes a slide (240) extending from the ear (22) and slidable in the respective slide slot (12), and a hook (242) laterally extending from the slide (240) and releasably locked by the locking sheet (14). The hook (242) of each of the two snapping members (24) extends outward relative to each other.

Figure 4:
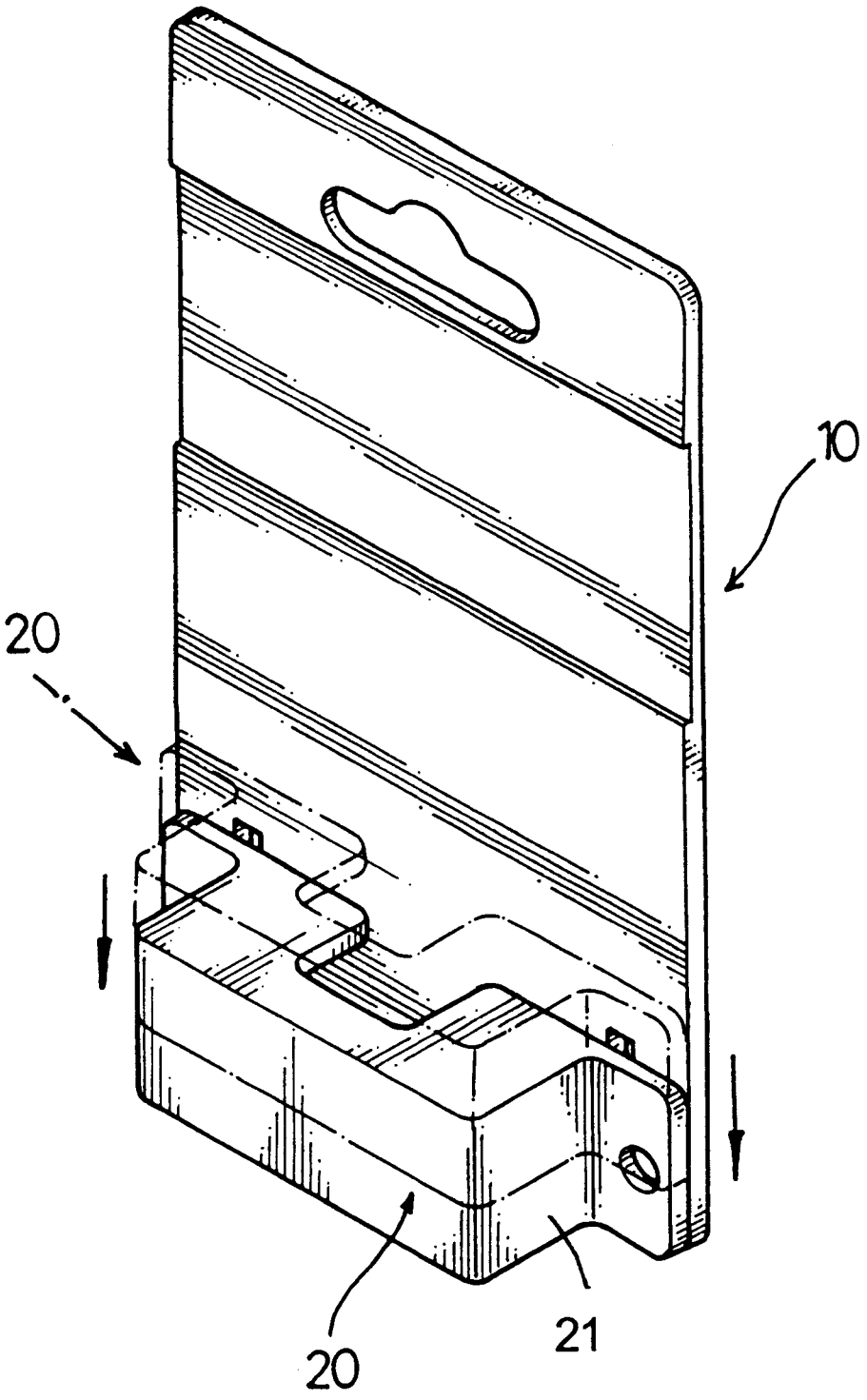
FIG. 4 is an operational view of the tool suspension rack as shown in FIG. 1.
Figure 5:
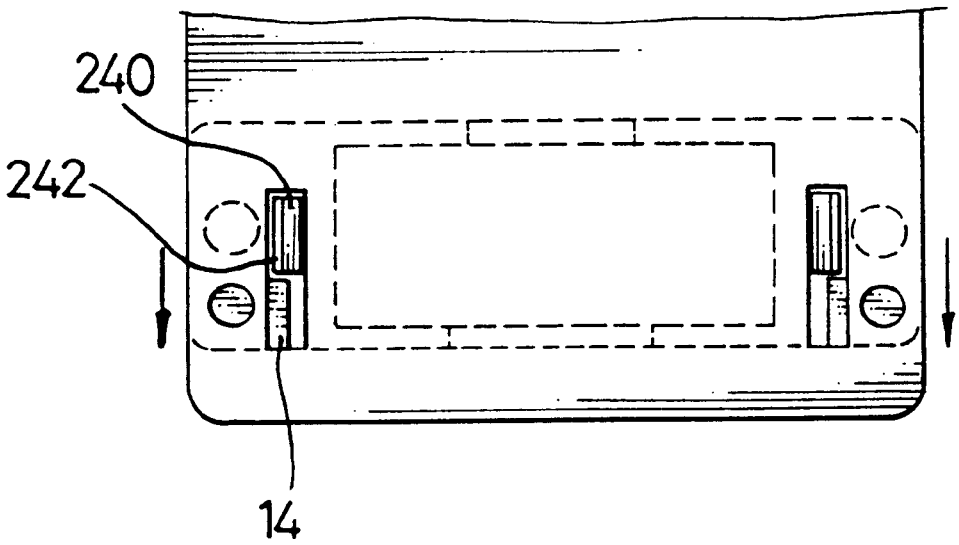
FIG. 5 is a rear plan view of the tool suspension rack as shown in FIG. 1.
Figure 6:
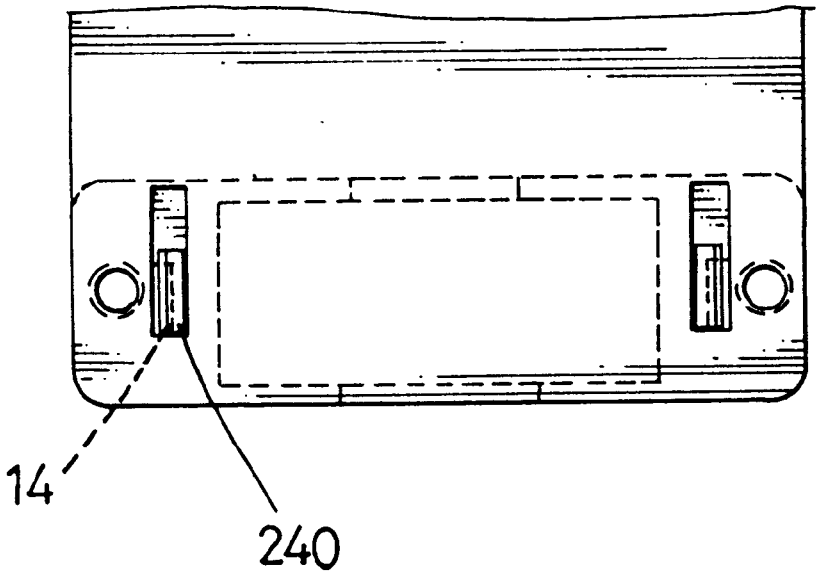
FIG. 6 is an operational view of the tool suspension rack as shown in FIG. 5.

In assembly, referring now to FIGS. 4–6 with reference to FIGS. 1–3, each of the two ears (22) of the supporting bracket (20) is moved to abut the second end portion 102 of the suspension plate (10), with the slide (240) of each of the two snapping members (24) being inserted into the upper end portion of the respective slot (12). Then, the supporting bracket (20) is moved downward along the direction as shown by the arrows in FIG. 4, whereby the slide (240) of each of the two snapping members (24) can be moved downward from the position as shown in FIG. 5 to the position as shown in FIG. 6 such that the hook (242) of each of the two snapping members (24) is locked by the respective locking sheet (14), thereby rigidly locking the supporting bracket (20) to the suspension plate (10) by means of the secure engagement between the hook (242) and the locking sheet (14).

Accordingly, each of the snapping members (24) is secured in the slot (12) by means of the secure engagement between the hook (242) and the locking sheet (14) such that the supporting bracket (20) is rigidly and stably mounted to the suspension plate (10), thereby capable of bearing the heavier weight of the tool (30). In addition, because the two snapping members (24) can be used continuously without being cut away, the suspension rack will have a longer lifetime.

Figure 7:
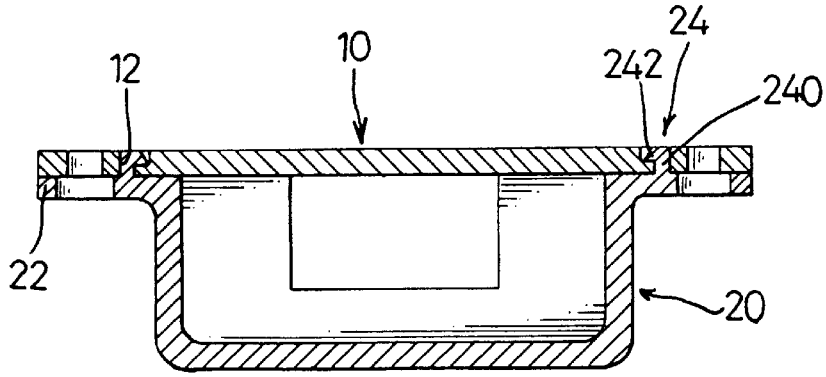
FIG. 7 is a top plan cross-sectional view of an alternative embodiment 3 the tool suspension rack as shown in FIG. 1.

In another embodiment, referring now to FIG. 7, the hook (242) of each of the two snapping members (24) extends inward relative to each other.

Figure 9:
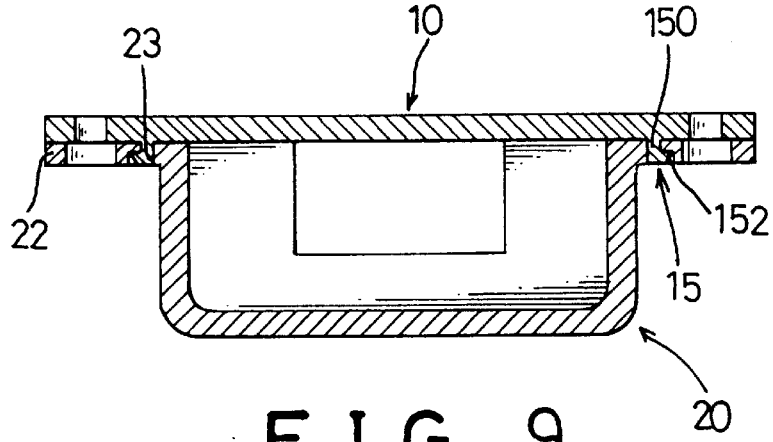
FIG. 9 is a top plan cross-sectional view of the tool suspension rack as shown in FIG. 8.
Figure 8:
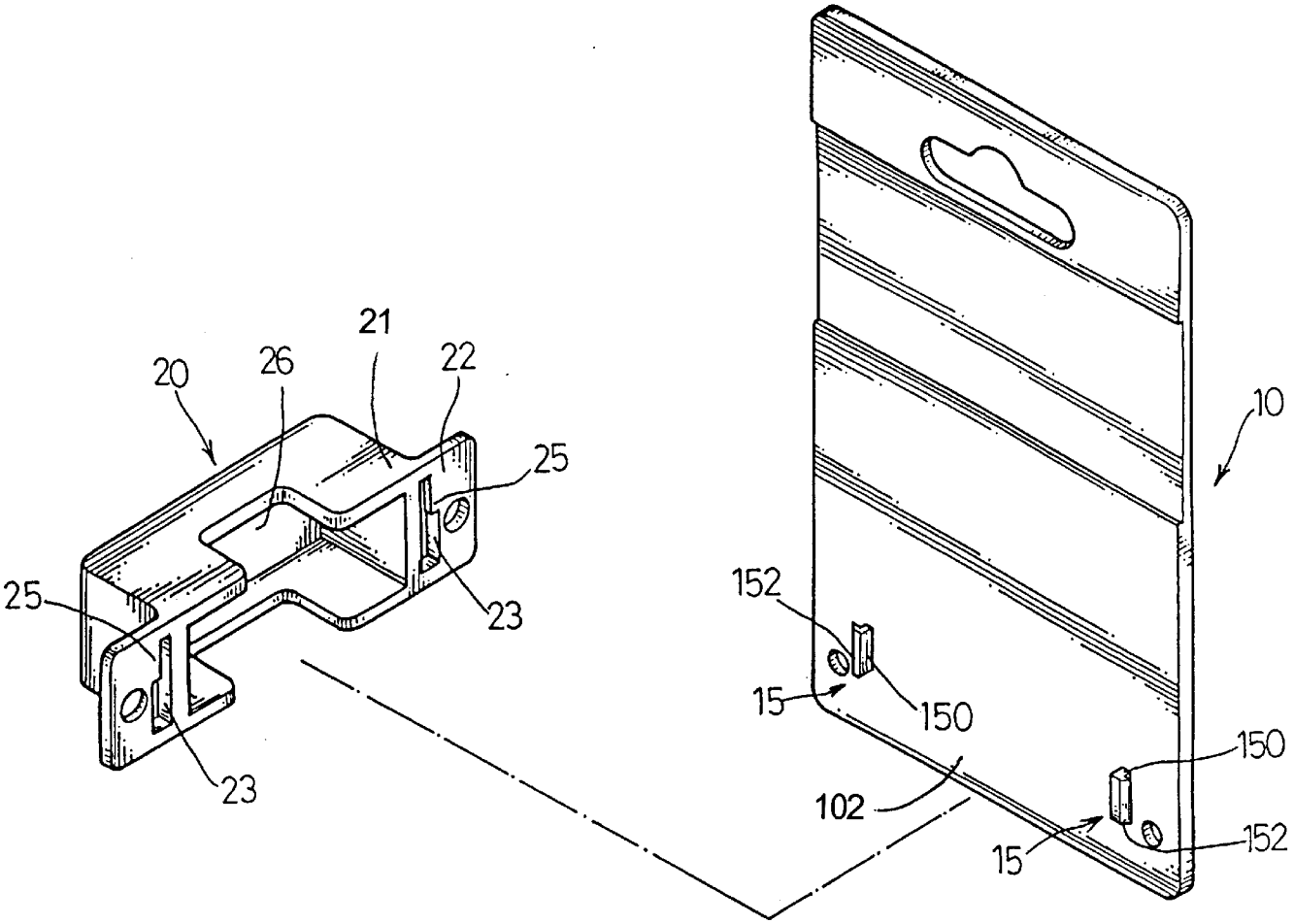
FIG. 8 is an exploded perspective view of a tool suspension rack in accordance with a second embodiment of the present invention.

Referring now to FIGS. 8 and 9, in accordance with a second embodiment of the present invention, the tool suspension rack comprises a suspension plate (10) including a first end portion and a second end portion (102), a substantially U-shaped supporting bracket (20) including two end portions (21) each formed with an ear (22) extending laterally and abutting the second end portion (102) of the suspension plate (10), the ear (22) containing an elongate slide slot (93) extending therethrough and having a first end portion and a second end portion formed with a locking sheet (25), and two spaced snapping members (15) each mounted on the second end portion of the suspension plate (10), wherein each of the two snapping members (15) is slidable in the respective slide slots (23) and is releasably locked by the locking sheet (25).

Each of the two snapping members (15) includes a slide (150) extending from the second end portion (102) of the suspension plate (10) and slidable in the respective slide slot (23), and a hook (152) laterally extending from the slide (150) and releasably locked by the locking sheet (25). The hook (152) of each of the two snapping members (15) extends outward relative to each other.

The assembly of the tool suspension rack is similar to that of the first embodiment as show in FIGS. 1–6, and will not be further described.

Figure 10:
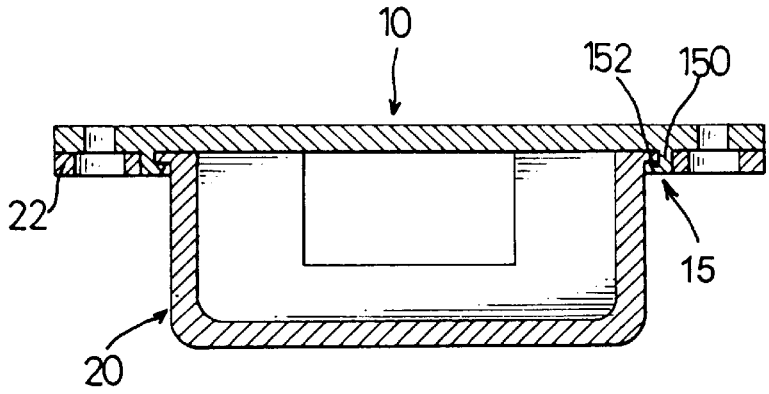
FIG. 10 is a top plan cross-sectional view of the tool suspension rack as shown in FIG. 8.

Referring now to FIG. 10, the hook (152) of each of the two snapping members (15) extends inward relative to each other.

It should be clear to those skilled in the art that further embodiments may be made without departing from the scope and spirit of the present invention.

What is claimed is:

1. A tool suspension rack comprising:

a suspension plate (10) including a first end portion and a second end portion containing two spaced elongate slide slots (12) extending therethrough, each of said two slide slots (12) having a first end portion and a second end portion formed with a locking sheet (14) that extends perpendicularly in an elongate direction into each of said slide slots;

a substantially U-shaped supporting bracket (20) including two end portions each formed with an ear (22) extending laterally and abutting the second end portion of said suspension plate (10); and two snapping members (24) each mounted on each of said two ears (22) of said supporting bracket (20), wherein each of said two snapping members (24) is slideable in one of said two corresponding slide slots (12) and is releasably locked by said locking sheet (14); wherein each of said two snapping members (24) includes a slide (240) extending from said ear (22) and slideable in said respective slide slot (12), and a hook (242) laterally extending from said slide (240) and releasably locked by said locking sheet (14).

2. The tool suspension rack in accordance with claim 1, wherein said hook (242) of each of said two snapping members (24) extends outward relative to each other.

3. The tool suspension rack in accordance with claim 1, wherein said hook (242) of each of said two snapping members (24) extends inward relative to each other.

4. A tool suspension rack comprising:

a suspension plate (10) including a first end portion and a second end portion;

a substantially U-shaped supporting bracket (20) including two end portions each formed with an ear (22) extending laterally and abutting the second end portion of said suspension plate (10), said ear (22) containing an elongate slide slot (23) extending therethrough and having a first end portion and a second end portion formed with a locking sheet (25) that extends perpendicularly in an elongate direction into said slide slot; and two spaced snapping members (15) each mounted on said second end portion of said suspension plate (10), wherein each of said two snapping members (15) is slideable in said respective slide slots (23) and is releasably locked by said locking sheet (25); wherein each of said two snapping members (15) includes a slide (150) extending from said second end portion of said suspension plate (10) and slideable in said respective slide slot (23), and a hook (152) laterally extending from said slide (150) and releasably locked by said locking sheet (25).

5. The tool suspension rack in accordance with claim 4, wherein said hook (152) of each of said two snapping members (15) extends outward relative to each other.

6. The tool suspension rack in accordance with claim 4, wherein said hook (152) of each of said two snapping members (15) extends inward relative to each other.

* * * * *